US007880644B2

(12) United States Patent
Stommel

(10) Patent No.: US 7,880,644 B2
(45) Date of Patent: Feb. 1, 2011

(54) METHOD AND SYSTEM FOR INFLUENCING THE TRAFFIC FLOW WITHIN A ROUTE SECTION

(75) Inventor: Matthias Stommel, Ganderkesee (DE)

(73) Assignee: Daubner & Stommel GbR Bau-Werk-Planung (DE)

( * ) Notice: Subject to any disclaimer, the term of this patent is extended or adjusted under 35 U.S.C. 154(b) by 527 days.

(21) Appl. No.: 11/945,475

(22) Filed: Nov. 27, 2007

(65) Prior Publication Data

US 2008/0143556 A1 Jun. 19, 2008

(30) Foreign Application Priority Data

Dec. 13, 2006 (DE) ..... 10 2006 059 239

(51) Int. Cl.
*G08G 1/01* (2006.01)

(52) U.S. Cl. ..... 340/936; 340/425.5; 340/470

(58) Field of Classification Search ..... 340/936, 340/425.5, 441, 905, 903, 466, 470
See application file for complete search history.

(56) References Cited

U.S. PATENT DOCUMENTS

| | | | | |
|---|---|---|---|---|
| 5,546,311 | A * | 8/1996 | Sekine | 340/902 |
| 5,748,476 | A * | 5/1998 | Sekine et al. | 340/903 |
| 6,125,324 | A * | 9/2000 | Matsuda et al. | 701/208 |
| 6,169,952 | B1 * | 1/2001 | Matsuda et al. | 340/905 |
| 6,708,107 | B2 * | 3/2004 | Impson et al. | 340/905 |
| 6,791,471 | B2 * | 9/2004 | Wehner et al. | 340/903 |
| 6,975,931 | B2 * | 12/2005 | Adachi | 701/96 |
| 7,092,723 | B2 * | 8/2006 | Himmelstein | 340/426.19 |
| 7,382,274 | B1 * | 6/2008 | Kermani et al. | 340/901 |
| 7,474,231 | B2 * | 1/2009 | Sohr | 340/903 |
| 2003/0187570 | A1 * | 10/2003 | Impson et al. | 340/905 |

(Continued)

FOREIGN PATENT DOCUMENTS

DE 24 00 880 A1 7/1975

(Continued)

OTHER PUBLICATIONS

DE Search Report.

(Continued)

*Primary Examiner*—Eric M Blount
(74) *Attorney, Agent, or Firm*—Smith, Gambrell & Russell

(57) ABSTRACT

A method for influencing the traffic flow of vehicles within a route section (10) in which the actual speed of a first vehicle travelling within the route section (10) is measured, at an actual speed which is the same as or higher than a predefined limiting value, signal-generating means (26, 28) which are assigned to the vehicle transmit at least one signal which can be received, in particular by another vehicle which is travelling in the route section (10) or the driver of the other vehicle, and which represents the fact that the limiting value has been reached or exceeded, and the signal which represents the fact that the limiting value has been reached or exceeded is received by a suitable receiver, in particular a receiver of the other vehicle, and triggers the recording and/or storage of a corresponding item of information, which represents the fact that the limiting value has been reached or exceeded, in a suitable storage medium, in particular in a storage medium of the other vehicle, and a system for carrying out the method.

16 Claims, 2 Drawing Sheets

U.S. PATENT DOCUMENTS

| | | | | |
|---|---|---|---|---|
| 2003/0204300 | A1* | 10/2003 | Adachi | 701/96 |
| 2008/0021600 | A1* | 1/2008 | Sohr | 701/1 |

FOREIGN PATENT DOCUMENTS

| | | | |
|---|---|---|---|
| DE | 40 34 681 | A1 | 5/1992 |
| DE | 195 06 420 | A1 | 8/1996 |
| DE | 199 00 929 | A1 | 8/2000 |
| DE | 199 03 909 | A1 | 8/2000 |
| DE | 10055874 | A1 | 5/2002 |
| DE | 10101652 | A1 | 7/2002 |
| DE | 103 16 451 | A1 | 10/2004 |
| DE | 103 36 590 | A1 | 2/2005 |
| EP | 1359047 | A | 11/2003 |
| GB | 2283353 | A | 5/1995 |
| WO | WO 2008/008404 | A | 1/2008 |

OTHER PUBLICATIONS

International Search Report issued in corresonding priority European Patent application No. EP 07021754 (Oct. 10, 2009).

* cited by examiner

METHOD AND SYSTEM FOR INFLUENCING THE TRAFFIC FLOW WITHIN A ROUTE SECTION

STATEMENT OF RELATED APPLICATIONS

This application claims convention priority on German Patent Application No. 10 2006 059 239.5 having a filing date of 13 Dec. 2006, which is incorporated herein by this reference.

BACKGROUND OF THE INVENTION

1. Technical Field

The present invention relates to a method for influencing the traffic flow of vehicles within a route section and to a system for carrying out the method.

2. Related Art

On motorways, various causes lead to traffic problems such as traffic jams, slow-moving traffic or the like. An important reason is the uncoordinated driving style of the various vehicles within a route section. For example, overtaking manoeuvres are in some cases performed by vehicles which are travelling at only a slightly higher speed than the vehicles which they are overtaking. Accordingly, long sections in which only a small number of vehicles are travelling come about before the overtaking vehicle while after the overtaking vehicle the traffic becomes congested.

This way of behaving of initiating overtaking manoeuvres with only a small differential speed with respect to the vehicle which is being overtaken occurs particularly frequently in the case of utility vehicles, such as lorries, for example. In Germany, many lorries and other utility vehicles are legally prohibited from travelling more quickly than a predefined maximum speed on motorways. This maximum speed is usually 60 km/h or 80 km/h depending on the utility vehicle. In order to comply with the maximum speed, the utility vehicles have in some cases corresponding limiters which limit the speed of the utility vehicles to the legally prescribed maximum speed. If, for example, a first lorry is travelling in the inside lane (right-hand lane in continental Europe) of the motorway at approximately 78 km/h and a further lorry which is travelling behind the latter initiates an overtaking manoeuvre at 80 km/h, the latter requires considerable time, owing to the small differential speed, to be able to travel past the first lorry. The formation of congestion is pre-programmed.

BRIEF SUMMARY OF THE INVENTION

Taking this prior art as a basis, the object of the present invention is to specify a method, a system and a vehicle of the type mentioned at the beginning with which the traffic flow within a route section can be influenced in a positive way.

This object is achieved by means of a method for influencing the traffic flow of vehicles, preferably utility vehicles within a route section, and by a system for influencing the traffic flow of vehicles.

According to the invention, a method for influencing the traffic flow of vehicles within a route section is accordingly specified which has the following steps:

(a) the actual speed of a first vehicle is measured, (b) at an actual speed which is the same as or higher than a predefined limiting value, signal-generating means which are assigned to the vehicle transmit at least one signal which can be received, in particular by another vehicle which is travelling in the route section or the driver of the other vehicle, and which represents the fact that the limiting value has been reached or exceeded, and (c) the signal which represents the fact that the limiting value has been reached or exceeded is received by a suitable receiver, in particular a receiver of the other vehicle, and triggers the recording and/or storage of a corresponding item of information, which represents the fact that the limiting value has been reached or exceeded, in a suitable storage medium, in particular in a storage medium of the other vehicle.

The method is appropriate in particular for utility vehicles, for example lorries. The speed limiting value preferably lies between the maximum possible top speed, or the legally permitted top speed of the first vehicle, on the one hand, and 90% of the maximum possible top speed, or 90% of the legally permitted top speed of this first vehicle, on the other.

The invention makes it possible to indicate to another lorry which is travelling behind a first lorry that the first lorry is travelling near to its maximum speed and an overtaking manoeuvre would therefore not be appropriate. Given appropriate legislation, this display can trigger a ban on overtaking for the lorry or lorries travelling behind. Protracted overtaking manoeuvres which cause traffic jams would then be prohibited.

The signal which represents the fact that the limiting value has been reached or exceeded is referred to for short as "overtaking ban signal" in the text which follows.

According to the invention, the overtaking ban signal triggers the recording or storage of corresponding information which represents the overtaking ban signal, specifically in a suitable storage medium. By means of the recording or storage of this information it is possible to document, for proof purposes, at least the fact that the overtaking ban signal was triggered.

The storage medium on which the information is stored is advantageously assigned to the other vehicle. The storage medium can be arranged here on or in the vehicle. In this case, the storage can be used not only to document that the signal has been triggered but also that the signal has also been transmitted to the other vehicle. This can, in particular, be appropriate for preventing the driver of the other vehicle from ignoring the triggered overtaking ban signal but, for example, denying having received the signal during a later check.

It is, however, alternatively or additionally conceivable for the storage medium to be arranged outside the other vehicle. For example, the storage medium can be a component of a central computer system which is connected to the first and/or the other vehicle via a remote data transmission. In this case, the information, which represents the overtaking ban signal, can be stored centrally. This central storage provides the proof that the overtaking ban signal was triggered by the first vehicle.

The overtaking ban signal advantageously carries information which is dependent on the speed of the first vehicle. The overtaking ban signal can then trigger the recording/storage of information which represents this speed in the storage medium which is assigned to the other vehicle.

In one particular embodiment of the invention, the information which represents the speed and/or the overtaking ban signal can be stored on a tachograph disc of a mechanical tachograph of the other vehicle. If a digital tachograph is used, this information can be stored in a digital memory which is assigned to the digital tachograph.

By means of the tachograph it is possible to check whether the other vehicle has received an overtaking ban signal while travelling. An increase in the speed of the other vehicle directly after reception of the overtaking ban signal and/or a steering movement of the vehicle on to the overtaking lane, which can possibly additionally be determined from the tachograph, can serve as an indication that the overtaking ban has been disregarded.

The overtaking ban signal can be a continuous signal, a signal sequence or else a chronologically limited signal.

The overtaking ban signal generated by the transmitter of the other vehicle can be received directly by a suitable receiver of the other vehicle by virtue of the fact that the signal is transmitted directly to the other vehicle without involvement of further transmitters and receivers. It can also be received indirectly by the receiver of the other vehicle. For example, the overtaking ban signal firstly can be transmitted, by means of remote data transmission to a suitable receiver of the above-mentioned central computer system which is arranged outside the other vehicle. The central computer system can then transmit a corresponding signal, likewise by means of remote data transmission to the suitable receiver of the other vehicle. As a person skilled in the art recognizes, a large number of possibilities are conceivable here.

The overtaking ban signal can indirectly trigger the outputting of an acoustic, optical or haptic signal in the other vehicle by virtue of the fact that the overtaking ban signal is firstly transmitted to the central computer system which then transmits a corresponding triggering signal to the receiver device of the other vehicle. The outputting of the acoustic, optical or haptic signal can also be triggered directly by virtue of the fact that the overtaking ban signal is transmitted directly to the receiver of the other vehicle and further processed there.

The acoustic, optical or haptic signal in vehicle of the other driver vehicle signals to said driver that it is not permitted to overtake the first vehicle owing to its high speed.

In a further embodiment, the overtaking ban signal can also trigger a light signal which is emitted, for example, by a light or a corresponding lighting means which is preferably arranged in the rear region of the first vehicle. Accordingly, the light signal of the light would signal that it is forbidden to overtake the first vehicle.

In a further preferred embodiment, after the emission of the overtaking ban signal, in particular after the direct or indirect reception thereof by the receiver of the other vehicle, the further driving movements of the other vehicle are monitored, at least for a specific time, to determine whether the other vehicle initiates and/or carries out an overtaking manoeuvre for overtaking the first vehicle. In particular, this monitoring takes place until the reception of a further signal which is output by the first vehicle and which represents the fact that the limiting value is no longer being reached or is no longer being exceeded.

The driving movements of the vehicle can be monitored, for example, by means of a superordinate locating system, in particular by means of GPS.

When an overtaking manoeuvre is detected, information which represents this fact is stored in a storage medium, in particular in a storage medium arranged in or on the vehicle or in a central storage medium in the way illustrated above.

The devices which are necessary for the specific implementation of the functions and methods described in this application, for example, signal generators, for example, for generating the overtaking ban signal or the acoustic optical or haptic signals, or control devices or the like, are known to a person skilled in the art and are not described in detail.

Of course, the overtaking ban signal of the first signal is generally not received by one vehicle but rather by a plurality of vehicles on the route section (directly or indirectly).

A system for carrying out the method described above has means for sensing the speed of the first vehicle, comparison means for comparing the sensed actual speed of the first vehicle with a predetermined limiting value and with signal-generating means which are assigned to the first vehicle, wherein, at an actual speed of the first vehicle, which is equal to or higher than the predetermined limiting value, a signal which represents the fact that the limiting value has been reached or exceeded, in particular a signal which can be received by the other vehicle, can be transmitted by the signal-generating means, and wherein the signal can trigger the recording and/or storage of corresponding information which represents the fact that the limiting value has been reached or exceeded in a suitable storage medium which is assigned to the other vehicle.

In one embodiment of the invention, the following steps are conceivable:

(a) at least two vehicles, preferably all the vehicles, within a route section exchange traffic-flow-related information bidirectionally with one another via communication devices which are assigned to the vehicles, (b) data which describes an optimized traffic flow is determined as a function of the traffic-flow-related information, and (c) display devices which are assigned to the vehicles display, in particular visually, or indicate, in particular acoustically, action instructions for the driver of the vehicle which are dependent on the optimized traffic flow data.

According to this aspect of the invention, communication devices which are assigned to the vehicles exchange different traffic flow information, for example speed information, inter-vehicle distance information, acceleration information and the like. For example, desired or setpoint speeds and/or distances between the vehicles and/or accelerations of the vehicles or further information which are predefined from the actual speeds of the vehicles and/or by the drivers of the vehicles are used to determine or calculate data which describe a future optimized traffic flow. These data which describe an optimized traffic flow are then converted into action instructions for the individual drivers.

For example, it can be indicated to the driver of a first vehicle, travelling initially in the overtaking lane (left-hand lane in continental Europe) of a motorway, by means of a screen arranged in the vehicle, that when there is a given traffic flow he should feed his vehicle into a gap appearing in the inside lane (right-hand lane) in order to permit other vehicles in the route section to be able to overtake in the left-hand lane which then becomes free. The action instructions can contain a wide variety of information, for example, information relating to acceleration, braking processes, steering processes and the like.

BRIEF DESCRIPTION OF THE DRAWINGS

Further features of the present invention emerge from the appended subclaims, the following description of a preferred exemplary embodiment and from the appended drawings, in which:

DETAILED DESCRIPTION OF PREFERRED EMBODIMENTS

Figure 1:
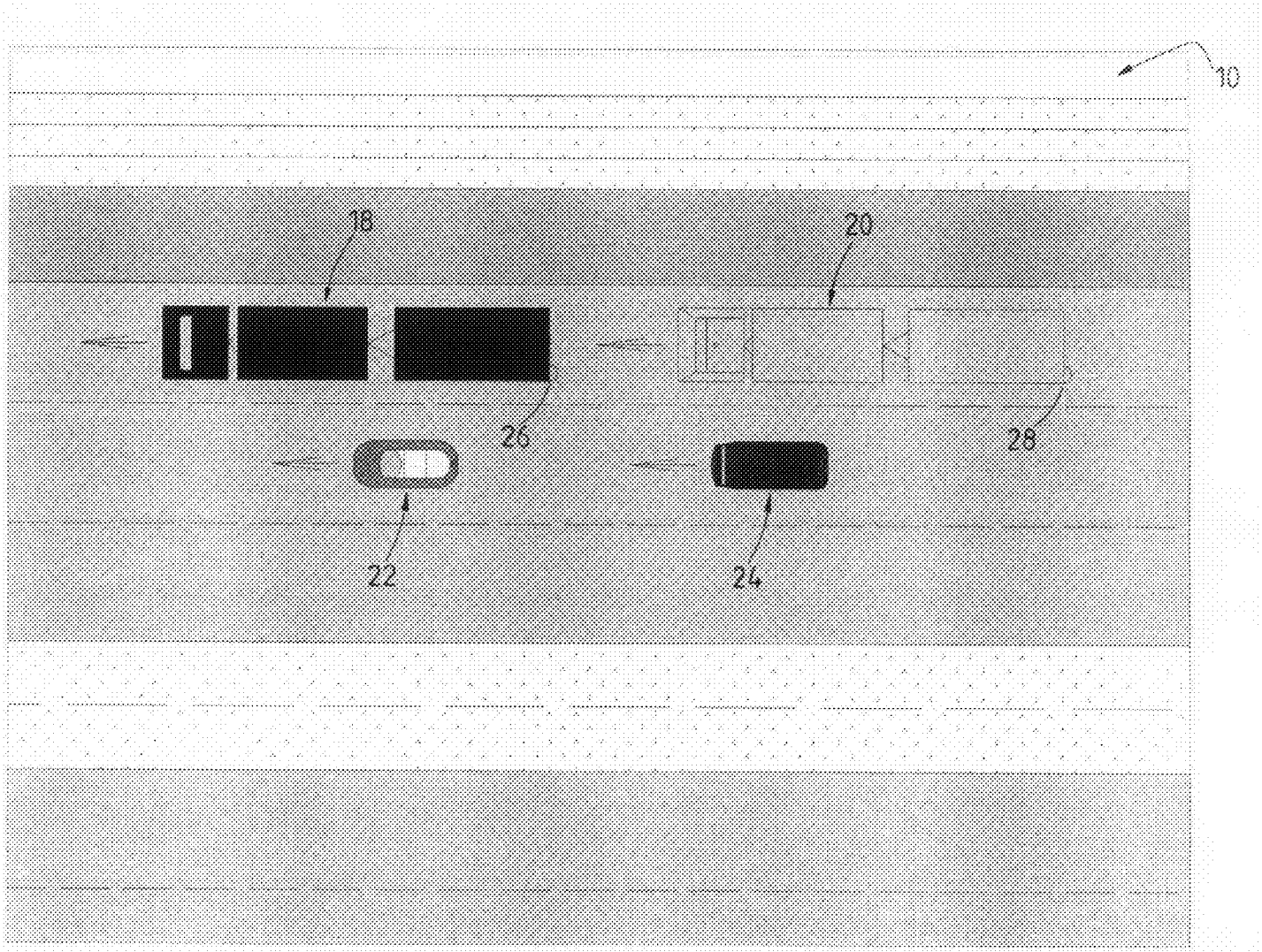
FIGS. 1 and 2 are schematic plan views of a route section of a motorway whose traffic flow is influenced with the methods according to the invention.

FIG. 1 shows a route section 10 of a three-lane continental motorway with lanes 12, 14 and 16.

In the right-hand lane 16 of the route section 10, two utility vehicles, specifically two lorries 18, 20 are travelling one behind the other. Two further vehicles, specifically passenger cars 22, 24 are travelling in the middle lane 14, to the left near to these lorries 18, 20.

Lights 26, 28 are arranged at the rear of the lorries 18, 20. The actual speed of the first lorry 18 of the route section 10 is measured. At an actual speed which is equal to or higher than a predefined limiting value of 76 km/h in this example, the light 26, to be more precise the lighting means which is integrated in the light 26, emits a light signal which can be received by the rear lorry 20 and which represents the fact that the limiting value has been reached or exceeded.

As soon as, after this, the lorry 18 reaches a speed near to the legally admissible top speed of 80 km/h, the light 26 is switched on. The driver of the lorry 20 following behind perceives the light signal of this light. He can therefore be informed that the speed of the lorry 18 is moving near to the top speed 80 km/h.

Owing to the maximum admissible top speed of 80 km/h which applies also to the lorry 20, the speed difference between the two lorries 18, 20 would in this case be so small that an overtaking manoeuvre would possibly take several minutes, which can lead to traffic jams.

In order to prevent this, given corresponding legal requirements, the light 26 automatically triggers an overtaking ban, i.e. does not permit the lorry 20 to overtake the lorry 18 travelling in front of it as soon as the light 26 emits a light signal.

In addition to a light signal there is provision for a signal which characterizes an overtaking ban to be triggered directly in the lorry 20 which is travelling behind.

For this purpose, when there is a corresponding actual speed, a transmitter which is assigned to the lorry 18 emits a radio signal which is received by a receiver device in the lorry 20. The signal can subsequently also be converted into an acoustic, optical or haptic signal. The acoustic, optical or haptic signal then also signals the existing overtaking ban to the driver.

The signal which is emitted by the lorry 18 influences a tachograph which is assigned to the lorry 20. The reception of the signal which characterizes the overtaking ban is noted on the tachograph. In addition, the signal which is output by the lorry 18 carries information about the speed of the lorry 18. This information and, if appropriate, further information is stored in suitable memories in the lorry 20 in order to be able to access the data in particular when checks are made.

The lorry 20 is equipped in the same way as the lorry 18 in order to be able to transmit corresponding signals, which characterize an overtaking ban, to further lorries.

Figure 2:
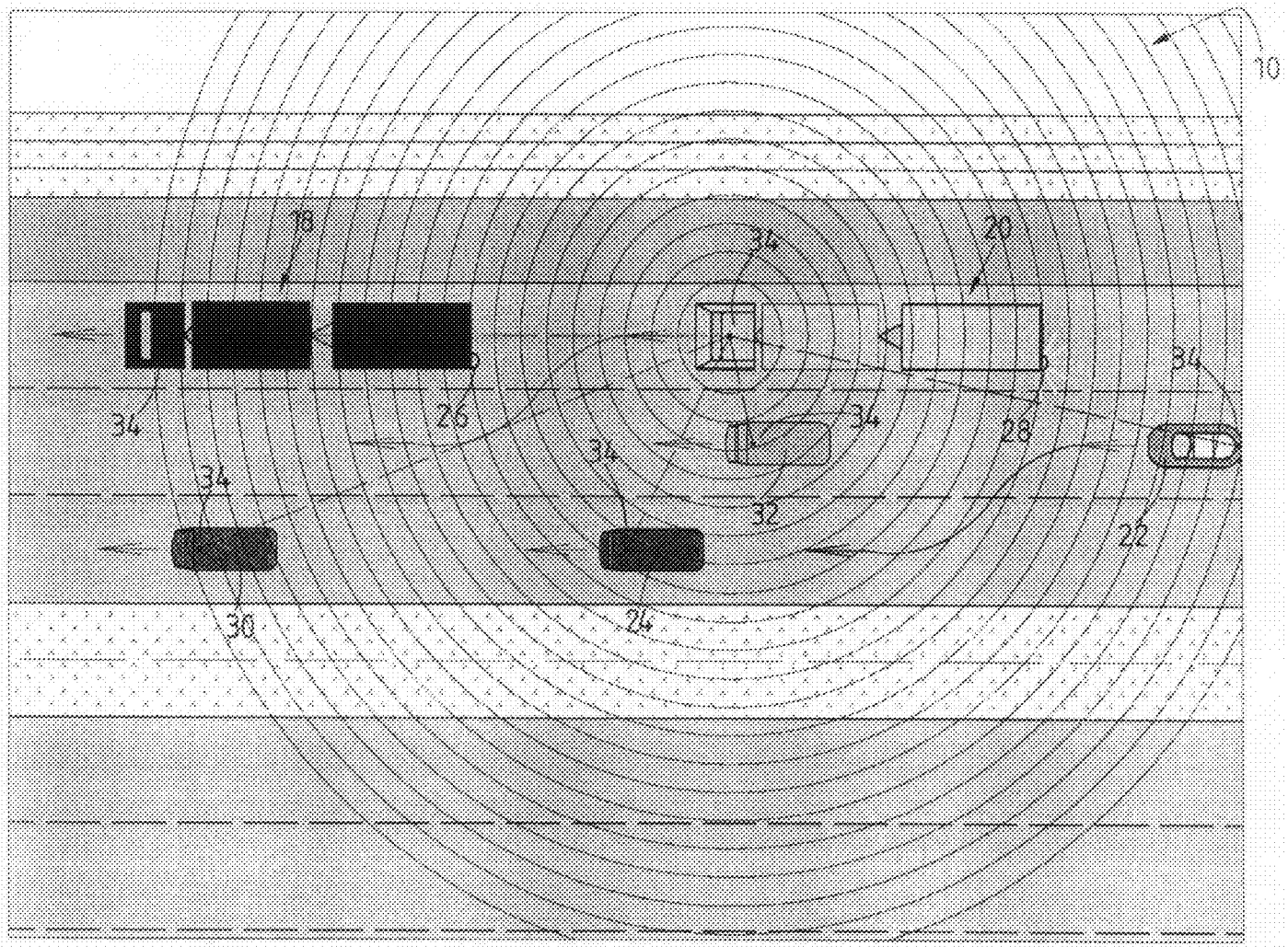

FIG. 2 shows a further illustration of the invention. The lorries 18, 20, the passenger cars 22, 24 and further passenger cars 30, 32 are each fitted with communication devices 34 with which the individual vehicles can communicate with one another in a wireless fashion by radio in the route section 10. The vehicles exchange information with one another via the communication devices 34, said information being, for example, their respective actual speed, their instantaneous acceleration, if appropriate, the distance between the vehicles and the respective vehicle which is travelling in front, if appropriate the desired average speed or further information.

The information which is exchanged is sensed by sensing devices which are assigned to the vehicles, for example, speed measuring devices, distance measuring sensors and the like.

An evaluation device which is assigned respectively to the individual vehicles calculates, as a function of this information, data which describes a (future) optimized traffic flow within the route section. As a function of this data, action instructions are respectively displayed to the drivers in the vehicles by means of suitable display devices.

For example, it is indicated to the driver of the passenger car 22 that at the average speed which he desires an overtaking manoeuvre would have to be initiated at the time T taking into account the further, traffic-flow-related data. Correspondingly, the driver would change the passenger car 22 over to the left-hand overtaking lane (continental Europe) at the time T if he complies with the action instruction.

As an alternative to the solution proposed here, it is also possible to provide a central evaluation unit by means of which the individual vehicles are connected in a wireless fashion, for example by means of a mobile radio.

LIST OF REFERENCE

10 Route section
12 Motorway
14 Middle lane
16 Right-hand lane
18 Lorry
20 Lorry
22 Passenger car
24 Passenger car
26 Light
28 Light
30 Passenger car
32 Passenger car
34 Communication devices

What is claimed is:

1. A method for influencing the traffic flow of vehicles within a route section (10) having the following steps:

(a) measuring the actual speed of a first vehicle travelling within the route section (10);

(b) at an actual speed which is the same as or higher than a predefined limiting value, using signal-generating means (26, 28) which are assigned to the first vehicle to transmit at least one signal which can be received by a second vehicle which is travelling in the route section (10) or by the driver of the second vehicle, and which represents the fact that the limiting value has been reached or exceeded; and (c) receiving the signal which represents the fact that the limiting value has been reached or exceeded by a suitable receiver in the second vehicle, and triggering the recording and/or storage of a corresponding item of information, which represents the fact that the limiting value has been reached or exceeded, in a suitable storage medium in the second vehicle, wherein the speed limiting value lies between the maximum possible top speed or the legally permitted top speed of the first vehicle and 90% of the maximum possible top speed or legally permitted top speed of the first vehicle.

2. The method according to claim 1, wherein the signal which represents the fact that the limiting value has been reached or exceeded indirectly or directly triggers the outputting of an acoustic, optical or haptic signal in the second vehicle after the signal which represents the fact that the limiting value has been reached or exceeded has been received by the suitable receiver in the second vehicle.

3. The method according to claim 1, characterized in that the signal which represents the fact that the limiting value has been reached or exceeded bears information which is dependent on the speed of the first vehicle.

4. The method according to claim 3, wherein the information which represents the speed and/or the fact that the limiting value has been reached or exceeded is stored by suitable recording on a tachograph disc of a mechanical tachograph of the second vehicle, or by storage in a digital storage medium of the second vehicle, or by storage in a digital memory of a digital tachograph.

5. The method according to claim 1, characterized in that the signal which represents the fact that the limiting value has been reached or exceeded is an electromagnetic signal selected from the group consisting of radio signals and light signals.

6. The method according to claim 1, wherein, after the information which represents the fact that the limiting value has been reached or exceeded is transmitted by the signal-generating means of the first vehicle and received by the receiver of the second vehicle, the further driving movements of the second vehicle are monitored for a specific time until the reception of a further signal which represents the fact that the limiting value is no longer being reached or no longer being exceeded, to determine whether the second vehicle initiates and/or carries out an overtaking manoeuvre for overtaking the first vehicle.

7. The method according to claim 6, wherein the driving movements of the first vehicle are monitored by means of a superordinate locating system.

8. The method according to claim 6, wherein when an overtaking manoeuvre is detected, information which represents this fact is stored in the storage medium of the second vehicle.

9. The method according to claim 1, wherein the speed limiting value lies between the maximum possible top speed or the legally permitted top speed of the first vehicle and 95% of the maximum possible top speed or legally permitted top speed of the first vehicle.

10. The method according to claim 1, wherein the speed limiting value lies between the maximum possible top speed or the legally permitted top speed of the first vehicle and 97% of the maximum possible top speed or legally permitted top speed of the first vehicle.

11. The method according to claim 1, having the following further steps:

(a) at least two vehicles within the route section exchanging traffic-flow-related information bidirectionally with one another via communication devices (34) which are assigned to the vehicles;

(b) determining data which describes an optimized traffic flow as a function of the traffic-flow-related information; and (c) using display devices which are assigned to the vehicles to display visually or indicate acoustically action instructions for the drivers of the vehicles which are dependent on the optimized traffic flow data.

12. The method according to claim 11, wherein the determination of the data which describes the optimized traffic flow is carried out in a decentralized fashion by evaluation devices assigned to the vehicles.

13. The method according to claim 11, wherein the traffic-flow-related information comprises speed-related and/or distance-related and/or acceleration-related information on the vehicles, the traffic-flow-related information being acquired at least partially using acquisition means which are assigned to the vehicles.

14. A system for influencing the traffic flow of vehicles, having:

(a) at least a first vehicle and at least one other vehicle;

(b) means for sensing the speed of the first vehicle;

(c) comparison means for comparing the sensed actual speed of the first vehicle with a predetermined limiting value and with signal-generating means which are assigned to the first vehicle, wherein, at an actual speed of the first vehicle, which is equal to or higher than the predetermined limiting value, a signal which represents the fact that the limiting value has been reached or exceeded and which can be received by the other vehicle, can be transmitted by the signal-generating means, wherein the signal can trigger the recording and/or storage of corresponding information which represents the fact that the limiting value has been reached or exceeded in a suitable storage medium which is assigned to the other vehicle, and wherein the speed limiting value lies between the maximum possible top speed or the legally permitted top speed of the first vehicle and 90% of the maximum possible top speed or legally permitted top speed of the first vehicle.

15. The system according to claim 14, wherein the signal which can be emitted by the signal-generating means is a radio signal that can be received by a receiver device in the other vehicle.

16. The system according to claim 15, wherein the system is operated by a method for influencing the traffic flow of vehicles within a route section (10) having the following steps:

(a) measuring the actual speed of a first vehicle travelling within the route section (10);

(b) at an actual speed which is the same as or higher than a predefined limiting value, using signal-generating means (26, 28) which are assigned to the first vehicle to transmit at least one signal which can be received by a second vehicle which is travelling in the route section (10) or by the driver of the second vehicle, and which represents the fact that the limiting value has been reached or exceeded; and (c) receiving the signal which represents the fact that the limiting value has been reached or exceeded by a suitable receiver in the second vehicle, and triggering the recording and/or storage of a corresponding item of information, which represents the fact that the limiting value has been reached or exceeded, in a suitable storage medium in the second vehicle.

* * * * *